US009263179B2

(12) United States Patent
Yoon et al.

(10) Patent No.: US 9,263,179 B2
(45) Date of Patent: Feb. 16, 2016

(54) COMMON MODE FILTER AND METHOD OF MANUFACTURING THE SAME

(71) Applicant: SAMSUNG ELECTRO-MECHANICS CO., LTD., Suwon-si, Gyeonggi-do (KR)

(72) Inventors: Chan Yoon, Suwon-si (KR); Won Chul Sim, Suwon-si (KR); Young Seuck Yoo, Suwon-si (KR); Sung Kwon Wi, Suwon-si (KR)

(73) Assignee: Samsung Electro-Mechanics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 13/831,315

(22) Filed: Mar. 14, 2013

(65) Prior Publication Data

US 2014/0167902 A1 Jun. 19, 2014

(30) Foreign Application Priority Data

Dec. 13, 2012 (KR) ..... 10-2012-0145512

(51) Int. Cl.

| | |
|---|---|
| ***H01F 5/00*** | (2006.01) |
| ***H01F 27/02*** | (2006.01) |
| ***H01F 27/29*** | (2006.01) |
| ***H01F 17/00*** | (2006.01) |

(52) U.S. Cl.

CPC ..... *H01F 27/292* (2013.01); *H01F 17/0013* (2013.01); *H01F 2017/0066* (2013.01); *H01F 2017/0093* (2013.01); *Y10T 29/4902* (2015.01)

(58) Field of Classification Search

CPC . H01F 5/003; H01F 17/0006; H01F 17/0013; H01F 27/255; H01F 27/2804

USPC ..... 336/83, 200, 223, 232–234

See application file for complete search history.

(56) References Cited

U.S. PATENT DOCUMENTS

| | | | | |
|---|---|---|---|---|
| 7,843,701 | B2 * | 11/2010 | Kudo et al. | 361/760 |
| 8,601,673 | B2 * | 12/2013 | Tseng | 29/606 |
| 2009/0045899 | A1 * | 2/2009 | Masai et al. | 336/172 |
| 2010/0157565 | A1 * | 6/2010 | Yoshida et al. | 361/811 |
| 2011/0291790 | A1 * | 12/2011 | Okumura et al. | 336/200 |
| 2012/0133472 | A1 * | 5/2012 | Nishikawa et al. | 336/200 |

FOREIGN PATENT DOCUMENTS

| | | |
|---|---|---|
| KR | 10-2001-0009995 | 2/2001 |
| KR | 10-2007-0076722 | 7/2007 |

* cited by examiner

*Primary Examiner* — Mangtin Lian

(74) *Attorney, Agent, or Firm* — McDermott Will & Emery LLP

(57) ABSTRACT

Disclosed herein are a common mode filter capable of implementing high inductance without deterioration of a moisture resistance load, and a method of manufacturing the same. The common mode filter includes: a magnetic substrate; an insulating layer disposed on the magnetic substrate; and a coil electrode layer disposed in the insulating layer, wherein the magnetic substrate has a groove part formed at an edge of an upper surface thereof, and a material of the insulating layer is filled into the groove part.

13 Claims, 5 Drawing Sheets

COMMON MODE FILTER AND METHOD OF MANUFACTURING THE SAME

CROSS REFERENCE(S) TO RELATED APPLICATIONS

This application claims the benefit under 35 U.S.C. Section 119 of Korean Patent Application Serial No. 10-2012-0145512, entitled "Common Mode Filter and Method of Manufacturing the Same" filed on Dec. 13, 2012, which is hereby incorporated by reference in its entirety into this application.

BACKGROUND OF THE INVENTION

1. Technical Field

The present invention relates to a common mode filter, and more particularly, to a common mode filter in which a structure of a magnetic substrate is deformed, and a method of manufacturing the same.

2. Description of the Related Art

Recently, electronic devices such as a cellular phone, a home appliance, a personal computer (PC), a personal digital assistant (PDA), a liquid crystal display (LCD), and the like, have been gradually digitalized and a speed of the electronic devices has gradually increased. Since these electronic devices are sensitive to stimulus from the outside, in the case in which small abnormal voltage and high frequency noise and introduced into the electronic devices from the outside, a circuit may be damaged or a signal may be distorted.

An example of the above-mentioned abnormal voltage and noise includes lightning, electrostatic discharge charged in a human body, switching voltage generated in the circuit, power noise included in power supply voltage, an unnecessary electromagnetic signal, electromagnetic noise, or the like. As a unit for preventing the above-mentioned abnormal voltage and high frequency noise from being introduced into the circuit, a common mode filter has been used.

Describing a general structure of a common mode filter with reference to Korean Patent Laid-Open Publication No. 10-2007-0076722, the common mode filter has a structure in which a pair of conductor coils magnetically coupled to each other is formed on a magnetic substrate and is enclosed by an insulating resin. That is, the common mode filter has a structure in which the magnetic substrate and an insulating layer are stacked when being viewed from the outside.

Therefore, external moisture permeates into an element through a space between the magnetic substrate and the insulating layer and arrives at the conductor coil to deteriorate a moisture resistance load of the common mode filter. Therefore, in order to prevent this problem, an interval between the outermost portion of the conductor coil and a side of the insulating layer, that is, a margin part has been formed to be large.

However, as the margin part becomes large, a space of the conductor coil is limited, such that a turn of the conductor coil cannot but be decreased. In this case, it is difficult to satisfy a required inductance value. This problem is gradually intensified as the common mode filter is miniaturized. Therefore, a common mode filter capable of implementing a high inductance value simultaneously with increasing a margin part, and a method of manufacturing the same have been urgently demanded.

RELATED ART DOCUMENT

Patent Document (Patent Document 1) Korean Patent Laid-Open Publication No. 10-2007-0076722

SUMMARY OF THE INVENTION

An object of the present invention is to provide a common mode filter capable of preventing a moisture resistance load without increasing a margin part and implementing high inductance, and a method of manufacturing the same.

According to a preferred embodiment of the present invention, there is provided a common mode filter including: a magnetic substrate; an insulating layer disposed on the magnetic substrate; and a coil electrode layer disposed in the insulating layer, wherein the magnetic substrate has a groove part formed at an edge of an upper surface thereof, and a material of the insulating layer is filled into the groove part.

An internal corner of the groove part may be formed at a right angle.

A height of the groove part may be 0.1 to 0.3 times smaller than a thickness of the magnetic substrate.

A width of the groove part formed at a long side of the magnetic substrate may be 0.1 to 0.3 times smaller than a length of the long side of the magnetic substrate.

A width of the groove part formed at a short side of the magnetic substrate may be 0.1 to 0.3 times smaller than a length of the short side of the magnetic substrate.

An inner side surface of the groove part may be formed as a curved surface having a predetermined radius of curvature.

The groove part may be formed in a stair form.

The groove part may have a wider width at a lower portion thereof than at an upper portion thereof.

The coil electrode layer may be configured of a pair of conductor coils spaced apart from each other by a predetermined interval.

The common mode filter may further include: external electrodes formed on an upper surface of the insulating layer and connected to both ends of each of the conductor coils; and a magnetic composite disposed between the external electrodes.

According to another exemplary embodiment of the present invention, there is provided a method of manufacturing a common mode filter, including: preparing a magnetic substrate; forming a groove part at an edge of an upper surface of the magnetic substrate; applying an insulating layer onto a surface of the magnetic substrate as well as an inner portion of the groove part; and plating a coil electrode layer on the insulating layer and forming an insulating layer so as to cover the coil electrode layer.

In the forming of the groove part, a photolithography process or a laser process may be used.

The method may further include: plating external electrodes at a predetermined thickness on an upper surface of the insulating layer; and forming a magnetic composite between the external electrodes.

DESCRIPTION OF THE PREFERRED EMBODIMENTS

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art.

Terms used in the present specification are for explaining exemplary embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

Figure 1:
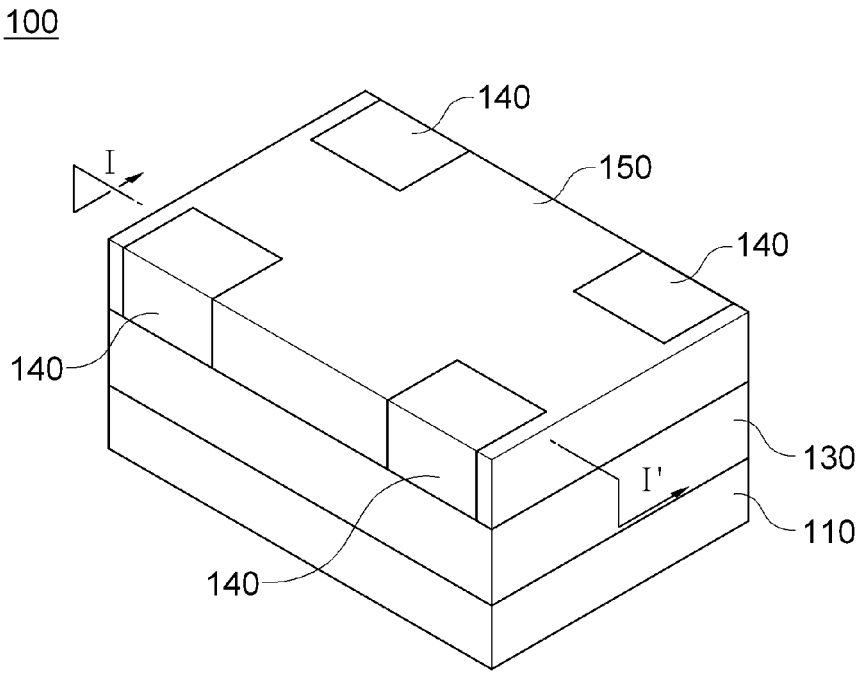
FIG. 1 is a perspective view of a common mode filter according to an exemplary embodiment of the present invention.
Figure 2:
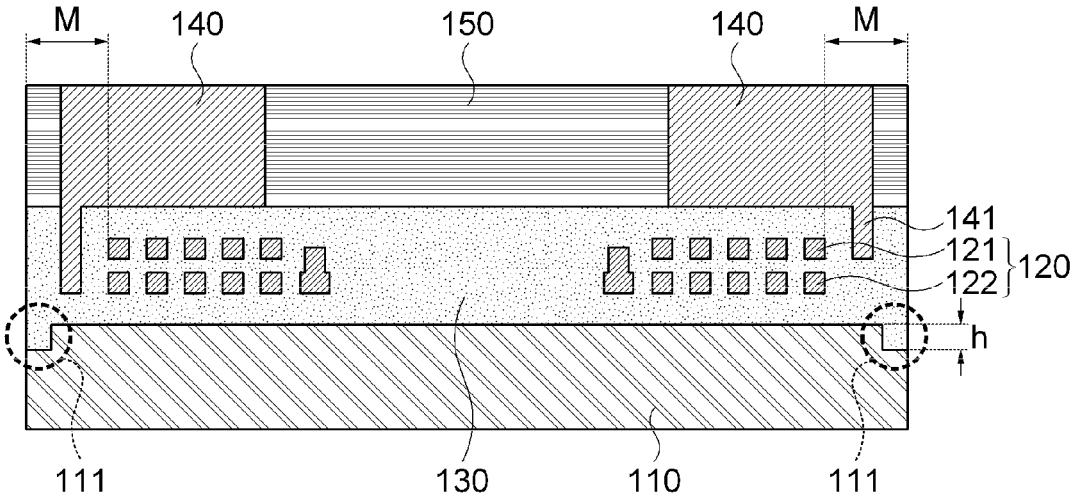
FIG. 2 is a cross-sectional view taken along the line I-I' of FIG. 1.
Figure 3:
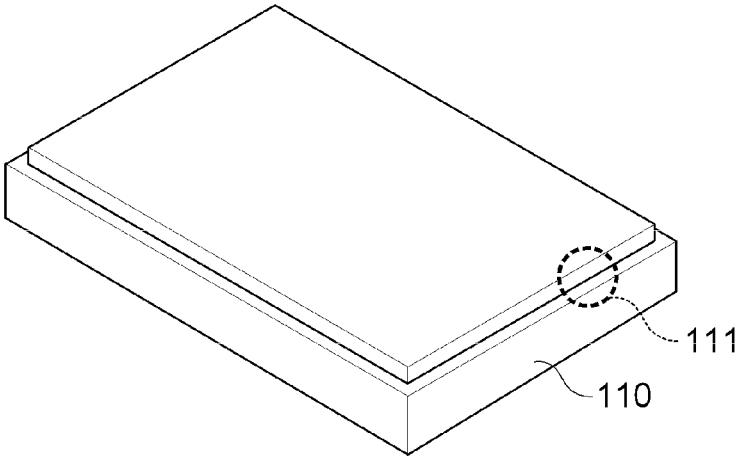
FIG. 3 is a perspective view of a magnetic substrate included in the common mode filter according to the exemplary embodiment of the present invention.
Figure 4:
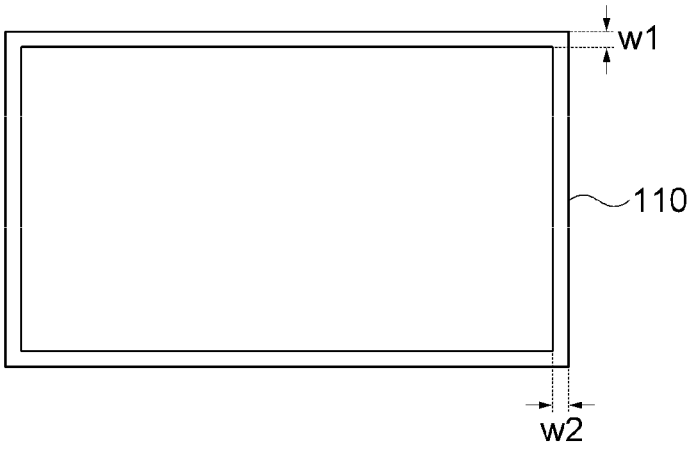
FIG. 4 is a plan view of the magnetic substrate included in the common mode filter according to the exemplary embodiment of the present invention.

FIG. 1 is a perspective view of a common mode filter according to an exemplary embodiment of the present invention; and FIG. 2 is a cross-sectional view taken along the line I-I' of FIG. 1. In addition, FIG. 3 is a perspective view of a magnetic substrate included in the common mode filter according to the exemplary embodiment of the present invention; and FIG. 4 is a plan view of the magnetic substrate included in the common mode filter according to the exemplary embodiment of the present invention.

Additionally, components shown in the accompanying drawings are not necessarily shown to scale. For example, sizes of some components shown in the accompanying drawings may be exaggerated as compared with other components in order to assist in the understanding of the exemplary embodiments of the present invention. Meanwhile, throughout the accompanying drawings, the same reference numerals will be used to describe the same components. For simplification and clearness of illustration, a general configuration scheme will be shown in the accompanying drawings, and a detailed description of the feature and the technology well known in the art will be omitted in order to prevent a discussion of exemplary embodiments of the present invention from being unnecessarily obscure.

Referring to FIGS. 1 and 2, the common mode filter 100 according to the exemplary embodiment of the present invention may include a magnetic substrate 110, an insulating layer 130 having a coil electrode layer 120 disposed therein, external electrodes 140 disposed on the insulating layer 130, and a magnetic composite 150 disposed between the external electrodes 140.

The insulating layer 130, which is a layer insulating between the magnetic substrate 110 and the coil electrode layer 120 and protecting the coil insulating layer 120 from the outside, may be made of a material appropriately selected in consideration of an insulation property, a heat resistance property, a moisture resistance property, and the like. For example, as an optimal polymer material configuring the insulating layer 130, a thermosetting resin such as an epoxy resin, a phenol resin, an urethane resin, a silicon resin, a polyimide resin, or the like, and a thermoplastic resin such as a polycarbonate resin, an acrylic resin, a polyacetal resin, a polypropylene resin, or the like, may be used, and a resin (for example, prepreg) having a reinforcing material such as a glass fiber or an inorganic filler impregnated in the thermosetting resin and the thermoplastic resin may also be used.

The coil electrode layer 120 may be configured of a pair of conductor coils 121 and 122 spaced apart from each other by a predetermined interval and electromagnetically coupled to each other. Both ends of each of the conductor coils 121 and 122 may be connected to the external electrodes 140 through a via 141 and a lead wire (not shown). Therefore, the common mode filter according to the exemplary embodiment of the present invention may have a total of four input/output terminals.

In the present invention, the coil electrode layer 120 is not necessarily configured in the above-mentioned structure, but may also have a structure in which four conductor coils are spaced apart from each other by a predetermined interval and are connected to each other in pair, or two conductor coils are plated on the same plane.

In addition, a margin part M, that is, an interval between the outermost portion of the conductor coils 121 and 122 and a side of the insulating layer 130 may be formed at a distance as short as possible in a range in which an insulation property, a heat resistance property, a moisture resistance property, and the like, are ensured. Therefore, in the present invention, the coil electrode layer 120 may have a maximum area. Accordingly, the common mode filter 100 according to the exemplary embodiment of the present invention may easily implement a required inductance value.

In the case in which the margin part M is short as described above, there is a risk that a moisture resistance load will be deteriorated. However, due to a structure of the magnetic substrate 1100 described below, in the common mode filter 100 according to the exemplary embodiment of the present invention, a deterioration phenomenon of the moisture resistance load does not occur.

First, the magnetic substrate 110 is made of Ni—Zn, Mn—Zn based, Ni—Zn based, Ni—Zn—Mg based, or Mn—Mg—Zn based ferrite that has high electrical resistance and low magnetic force loss and may easily design impedance through a composition change, or a mixture thereof, such that it becomes a space in which a magnetic path is formed. Therefore, when voltage is applied from the external electrode 140, a magnetic flux generated in the coil electrode layer 120 is not leaked, such that inductance may be increased and high common mode impedance may be implemented.

The magnetic substrate 110 has a groove part 111 formed along an edge of an upper surface thereof as shown in FIGS. 2 to 4. Therefore, a material of the insulating layer 130 disposed on an upper surface of the magnetic substrate 110 is also filled in the groove part 111. More specifically, an internal corner of the groove part 111 is formed at a right angle.

According to the above-mentioned structure, a movement path (hereinafter, referred to as a permeation path) of moisture permeated from the outside becomes an interface of the groove part 111, and a length thereof becomes the sum of a height h and a width w of the groove part 111. Since the permeation path is increased by the groove part 111 as described above, even though the margin part M is short, the coil electrode layer 120 may be protected from the external moisture.

Here, it is preferable that the height h of the groove part 111 is 0.1 to 0.3 times smaller than a thickness of the magnetic substrate 110. In addition, it is preferable that a width w1 of the groove part 111 formed at a long side of the magnetic substrate 110 is 0.1 to 0.3 times smaller than a length of the long side of the magnetic substrate 110, and a width w2 of the groove part 111 formed at a short side of the magnetic substrate 110 is 0.1 to 0.3 times smaller than a length of the short side of the magnetic substrate 110.

The larger the height h and the width w of the groove part 111, the larger the permeation path is, such that reliability for the moisture resistance load is increased. However, when the height h and the width w of the groove part 111 are excessively large, since a magnetic material is lost by a volume corresponding to the height and the width, it is preferable that the height h and the width w of the groove part 111 has an appropriate value in the above-mentioned numerical range. However, since the above-mentioned numerical range is a range for limiting an optimal value capable of implementing the effect of the present invention, it is obvious to those skilled in the art that a value that is slightly out of the numeral range may be allowed.

Figure 5:
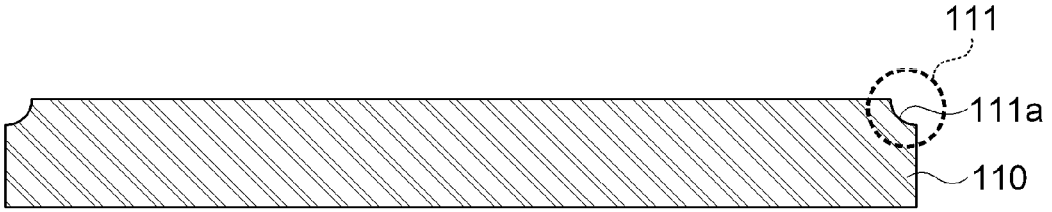
FIGS. 5 to 7 are cross-sectional views of a magnetic substrate included in a common mode filter according to another exemplary embodiment of the present invention.

As shown in FIGS. 2 to 4, the internal corner of the groove part 111 is generally formed at a right angle. However, as one of various modified examples, an inner side surface 111*a* of the groove part 111 may be formed as a curved surface having a predetermined radius of curvature as shown in FIG. 5. In this case, the larger the radius of curvature, the larger the length of the permeation path is, such that the reliability for the moisture resistance load may be improved.

However, no matter how large the curvature of radius is, a length of the permeation path cannot be short than the groove part 111 of FIGS. 2 to 4. In addition, in the case in which a right angle internal corner is present, since stairs are formed to block a flow of the moisture by a step therebetween, it is more preferable to form the groove part 111 having a right angle internal corner as shown in FIGS. 2 to 4.

As a result of performing a moisture resistance test on a common mode filter of a 0806 size of which common mode impedance is 90 Ω for 500±12 hours under conditions such as 60±3° C., 90-95% RH, DC10V, and DC100 mA, it could be appreciated that in the case of using a magnetic substrate in which the groove part 111 having a right angle internal corner is formed, insulation resistance is 1.09E+07, which is a normal value; however, otherwise, insulation resistance is 9.03E+09, which is a low value, such that moisture permeated from the outside easily arrives at the coil electrode layer in the structure according to the related art.

As described above, the common mode filter 100 according to the exemplary embodiment of the present invention uses the magnetic substrate 110 in which the groove part 111 is formed to increase the length of the permeation path, thereby making it possible to prevent deterioration of the moisture resistance load. Therefore, the margin part M needs not to be formed to be large, such that an area of the coil electrode layer 120 may be increased as large as possible. As a result, it is possible to implement high inductance.

Figure 6:
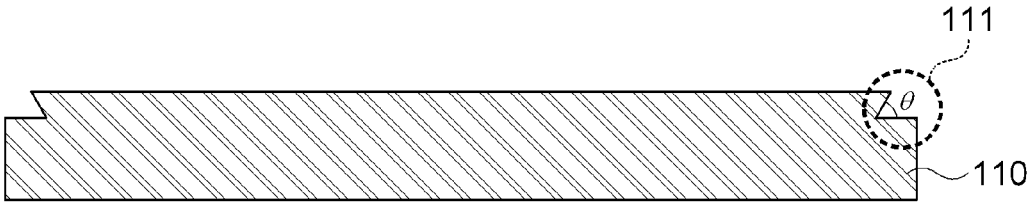
Figure 7:
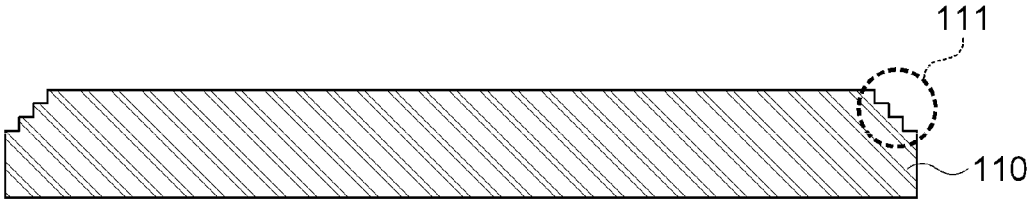

Meanwhile, FIGS. 6 and 7 are views for describing a form of the groove part 111 according to another exemplary embodiment of the present invention. In order to more securely block the permeation path, the groove part 111 may be formed to have a wider width at a lower portion thereof than at an upper portion thereof, such that an angle (θ) of the internal corner is less than 90 degrees as shown in FIG. 6 or be formed in a stair form as shown in FIG. 7.

In the case in which the internal corner of the groove part 111 has an angle less than 90 degrees to thereby be depressed into the magnetic substrate 110 as shown in FIG. 6, since a length of the permeation path is further increased as compared with the groove part 111 of FIGS. 2 to 4 and a flow of the moisture may be blocked at the depressed corner, the reliability for the moisture resistance load may be significantly increased.

Therefore, in the groove part 111 having the above-mentioned form, the smaller the angle (θ) of the internal corner, the higher the reliability for the moisture resistance load. However, when the angle of the internal corner is excessively small, since loss of a magnetic material is increased and it is difficult to implement the above-mentioned form at the time of manufacturing the common mode filter, it is preferable that the angle (θ) of the internal corner is in a range of 60 to 90 degrees.

In addition, in the case in which the groove part 111 is formed in the stair form as shown in FIG. 7, several stairs are formed to block a flow of the moisture by a step therebetween, the reliability for the moisture resistance load may be significantly increased.

Therefore, in the groove part 111 having the above-mentioned form, the more the number of stages, the higher the reliability for the moisture resistance load. However, when the number of stairs is excessively many, a height or a width of the groove part 111 becomes large, such that the loss of the magnetic material is increased, and when the number of stairs is increased in a state in which a height or a width of the groove part 111 is limited, the step between the stairs, such that it is difficult to show an effect by the stair form. Therefore, in the case in which the groove part 111 is formed in the stair form, the number of stairs should be carefully selected in consideration of the height and the width of the groove part 111.

Hereinafter, a method of manufacturing a common mode filter 100 according to the exemplary embodiment of the present invention will be described.

Figure 8:
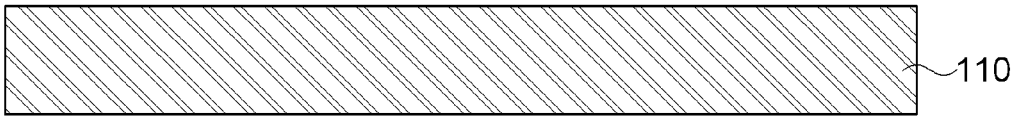
FIGS. 8 to 12 are views sequentially showing processes of a method of manufacturing a common mode filter according to the exemplary embodiment of the present invention.

FIGS. 8 to 12 are views sequentially showing processes of a method of manufacturing a common mode filter 100 according to the exemplary embodiment of the present invention. In the method of manufacturing a common mode filter 100 according to the exemplary embodiment of the present invention, the magnetic substrate 110 having a predetermined size is first prepared as shown in FIG. 8.

The magnetic substrate 110 is made of Ni—Zn, Mn—Zn based, Ni—Zn based, Ni—Zn—Mg based, or Mn—Mg—Zn based ferrite, or a mixture thereof, and preferably has the same size as that of a finally completed common mode filter.

Figure 9:
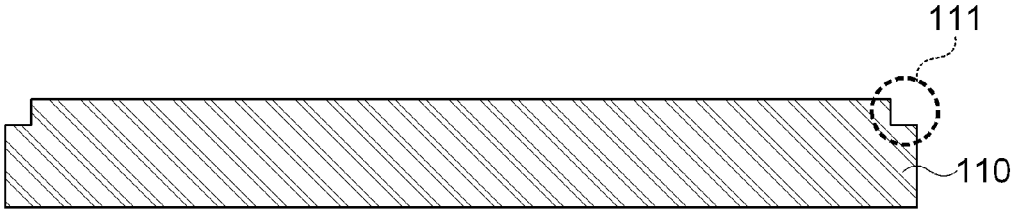

Then, as shown in FIG. 9, the groove part 111 is formed at an edge of an upper surface of the magnetic substrate 110.

The groove part 111 may be formed by a photolithography forming technology, a laser process such as a laser ablation process or a laser cutting process, or the like. In this case, the internal corner of the groove part 111 may be formed at a right angle or an inner side surface thereof may be formed to be a curved surface having a predetermined curvature of radius. Alternatively, the groove part 111 may be formed to have a wider width at a lower portion thereof than at an upper portion thereof or be formed in the stair form by performing a process several times.

Figure 10:
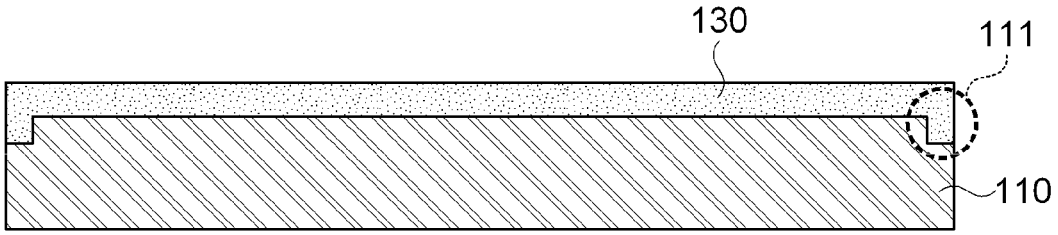

Then, as shown in FIG. 10, the insulating layer 130 is applied onto a surface of the magnetic substrate 110 by a well-known technology such as a dip coating method, a spin coating method, or the like. When the insulating layer 130 is applied onto the surface of the magnetic substrate 110 in which the groove part 111 is formed, a material of the insulating layer 130 is naturally filled in the groove part 111.

Figure 11:
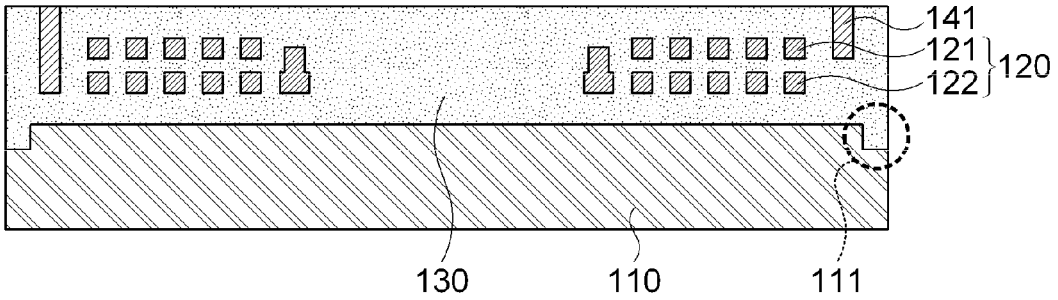

Then, a buildup process of alternately stacking the conductor coils 121 and 122 and the insulating layer covering the conductor coils 121 and 122 is performed to complete the insulating layer 130 covering the coil electrode layer 120 as shown in FIG. 11.

The conductor coils 121 and 122 may be plated by a well-known plating forming method such as a subtractive method, an additive method, a semi-additive method, or the like. At this time, the via 141 and lead wire (not shown) for electrical connection with the external electrode may also be plated.

Figure 12:
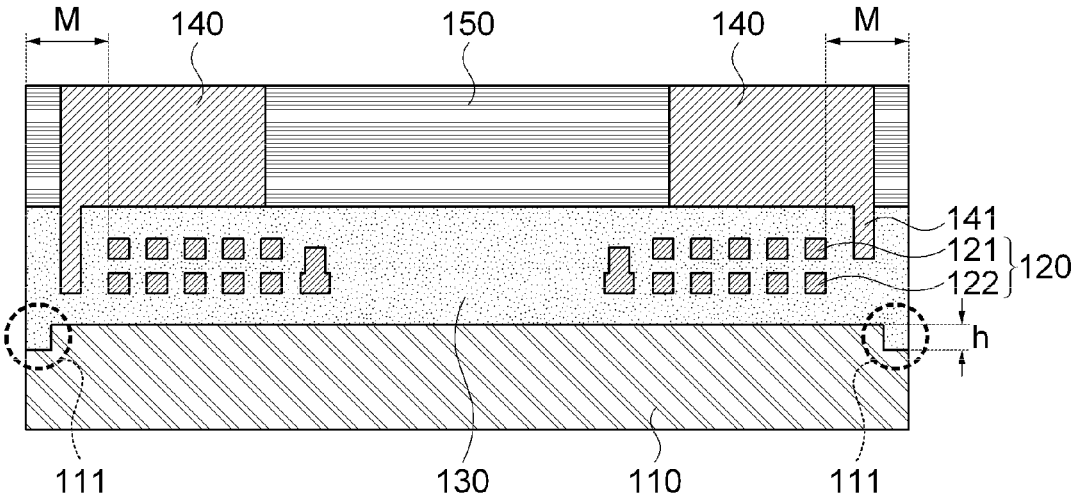

Next, finally, as shown in FIG. 12, the external electrodes 140 are plated at a predetermined thickness on an upper surface of the insulating layer 130, and a slurry produced by mixing a magnetic powder, an organic binder, and the like, with each other is filled and cured in the external electrodes 140 to form the magnetic composite 150, thereby finally completing the common mode filter according to the exemplary embodiment of the present invention.

With the common mode filter according to the exemplary embodiment of the present invention, the magnetic substrate in which the groove part is formed is used, such that a movement path of moisture permeated from the outside may be increased without forming a large margin part, thereby making it possible to implement high inductance without deterioration of the moisture resistance load.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A common mode filter comprising:
a magnetic substrate consisting of ferrite;
an insulating layer disposed on the magnetic substrate,
a coil electrode layer disposed in the insulating layer,
wherein the magnetic substrate has a groove part formed at an edge of an upper surface thereof, and a material of the insulating layer is filled in the groove part,
and the groove part is formed in a stair form.

2. The common mode filter according to claim 1, wherein an internal corner of the groove part is formed at a right angle.

3. The common mode filter according to claim 2, wherein a height of the groove part is 0.1 to 0.3 times smaller than a thickness of the magnetic substrate.

4. The common mode filter according to claim 2, wherein a width of the groove part formed at a long side of the magnetic substrate is 0.1 to 0.3 times smaller than a length of the long side of the magnetic substrate.

5. The common mode filter according to claim 2, wherein a width of the groove part formed at a short side of the magnetic substrate is 0.1 to 0.3 times smaller than a length of the short side of the magnetic substrate.

6. The common mode filter according to claim 1, wherein the coil electrode layer is configured of a pair of conductor coils spaced apart from each other by a predetermined interval.

7. The common mode filter according to claim 6, further comprising:
external electrodes formed on an upper surface of the insulating layer and connected to both ends of each of the conductor coils; and
a magnetic composite disposed between the external electrodes.

8. A common mode filter comprising:
a magnetic substrate consisting of ferrite;
an insulating layer disposed on the magnetic substrate,
a coil electrode layer disposed in the insulating layer,
wherein the magnetic substrate has a groove part formed at an edge of an upper surface thereof, and a material of the insulating layer is filled in the groove part,
and the groove part has a wider width at a lower portion thereof than at an upper portion thereof.

9. The common mode filter according to claim 8, wherein a height of the groove part is 0.1 to 0.3 times smaller than a thickness of the magnetic substrate.

10. The common mode filter according to claim 8, wherein a width of the groove part formed at a long side of the magnetic substrate is 0.1 to 0.3 times smaller than a length of the long side of the magnetic substrate.

11. The common mode filter according to claim 8, wherein a width of the groove part formed at a short side of the magnetic substrate is 0.1 to 0.3 times smaller than a length of the short side of the magnetic substrate.

12. The common mode filter according to claim 8, wherein the coil electrode layer is configured of a pair of conductor coils spaced apart from each other by a predetermined interval.

13. The common mode filter according to claim 12, further comprising:
external electrodes formed on an upper surface of the insulating layer and connected to both ends of each of the conductor coils; and
a magnetic composite disposed between the external electrodes.

* * * * *